US008438676B2

(12) United States Patent
Murphy

(10) Patent No.: US 8,438,676 B2
(45) Date of Patent: May 14, 2013

(54) SEATING UNIT CONVERTIBLE TO BED

(75) Inventor: Marcus L. Murphy, Lexington, NC (US)

(73) Assignee: Ultra-Mek, Inc., Denton, NC (US)

( * ) Notice: Subject to any disclaimer, the term of this patent is extended or adjusted under 35 U.S.C. 154(b) by 621 days.

(21) Appl. No.: 12/605,597

(22) Filed: Oct. 26, 2009

(65) Prior Publication Data

US 2011/0010847 A1 Jan. 20, 2011

Related U.S. Application Data

(63) Continuation-in-part of application No. 12/505,697, filed on Jul. 20, 2009.

(51) Int. Cl.
*A47C 17/23* (2006.01)

(52) U.S. Cl.
USPC ..... 5/35; 5/36; 5/31; 5/28; 5/33; 5/34

(58) Field of Classification Search ..... 5/13, 28, 5/29, 31–36
See application file for complete search history.

(56) References Cited

U.S. PATENT DOCUMENTS

| | | | | |
|---|---|---|---|---|
| 213,512 | A | 3/1879 | Landis | |
| 577,138 | A | 2/1897 | Hubbard | |
| 640,647 | A | 1/1900 | Gannett | |
| 1,018,593 | A | 2/1912 | Swanson | |
| 1,043,071 | A * | 11/1912 | Coppersmith | 5/36 |
| 1,218,608 | A * | 3/1917 | Arnold | 5/32.1 |
| 1,509,863 | A | 9/1924 | Erickson | |
| 1,945,186 | A * | 1/1934 | Frank | 5/36 |
| D151,983 | S | 12/1948 | Guertin | |
| D151,984 | S | 12/1948 | Guertin | |
| D160,390 | S | 10/1950 | Hubbert | |

(Continued)

FOREIGN PATENT DOCUMENTS

| | | |
|---|---|---|
| GB | 0002601 | 0/1900 |
| GB | 0240085 | 9/1925 |

OTHER PUBLICATIONS

Cover of *Highpoints* publication. Tiffany Sleeper, Market Introductions (Apr. 2000).

(Continued)

*Primary Examiner* — William Kelleher
(74) *Attorney, Agent, or Firm* — Myers Bigel Sibley & Sajovec, P.A.

(57) ABSTRACT

A seating unit containing a foldable bed includes: a seating unit frame having a pair of opposed arms; a housing including a storage cavity, the housing fixed to the arms of the seating unit frame; a seat section; an intermediate section; a head section; and a mechanism having pivotally interconnected links, the mechanism interconnecting the base with the head, intermediate and seat sections. The mechanism controls the movement of the head, intermediate and seat sections between a folded position, in which the head, intermediate and seat sections are positioned in vertically stacked relationship, with the head section below the intermediate section and the seat section above the intermediate section, the head and intermediate sections being positioned in the cavity of the housing, and the head and intermediate sections being generally horizontally disposed and the seat section having a pitch angle of between about 1 and 7 degrees to horizontal, and an unfolded position, in which the head, intermediate and seat sections are horizontally disposed and serially aligned to form a sleeping surface.

5 Claims, 10 Drawing Sheets

U.S. PATENT DOCUMENTS

| | | | | | |
|---|---|---|---|---|---|
| 2,577,741 | A | | 12/1951 | Creveling et al. | |
| 2,579,577 | A | | 12/1951 | Hill | |
| 2,582,703 | A | | 1/1952 | Kirshbaum | |
| 2,625,204 | A | | 1/1953 | Reichman | |
| 2,635,678 | A | | 4/1953 | Basil | |
| 2,664,145 | A | * | 12/1953 | Creveling al. | 5/36 |
| 2,696,870 | A | | 12/1954 | Mende | |
| 2,740,131 | A | | 4/1956 | Vogel et al. | |
| 2,786,213 | A | * | 3/1957 | Creveling al. | 5/31 |
| 2,804,122 | A | | 8/1957 | Baum | |
| 2,812,227 | A | | 11/1957 | Hill | |
| 2,838,097 | A | | 6/1958 | Gleitsmann et al. | |
| 2,876,461 | A | | 3/1959 | Bontempi | |
| 2,877,830 | A | | 3/1959 | Smith | |
| 2,950,753 | A | | 8/1960 | Gleitsman et al. | |
| 2,988,757 | A | * | 6/1961 | Hubbell al. | 5/36 |
| 3,114,574 | A | | 12/1963 | Pryale | |
| 3,121,237 | A | * | 2/1964 | Brindisi | 5/36 |
| 3,145,049 | A | | 8/1964 | Duke | |
| 3,227,112 | A | | 1/1966 | Wiseman | |
| 3,432,203 | A | * | 3/1969 | Cavalli | 297/109 |
| 3,451,718 | A | | 6/1969 | Kaufman | |
| 3,908,210 | A | | 9/1975 | Alembik | |
| 3,942,835 | A | | 3/1976 | Harrison | |
| 4,083,599 | A | | 4/1978 | Gaffney | |
| 4,557,080 | A | | 12/1985 | Walworth et al. | |
| 4,577,902 | A | | 3/1986 | Crum | |
| 4,669,778 | A | | 6/1987 | Rogers, Jr. | |
| 4,737,996 | A | | 4/1988 | Tiffany | |
| 4,834,449 | A | | 5/1989 | Engelman | |
| 4,946,222 | A | | 8/1990 | Matson | |
| 5,087,094 | A | | 2/1992 | Rogers, Jr. | |
| 5,160,183 | A | | 11/1992 | Rusyniak | |
| 5,186,518 | A | | 2/1993 | Pine | |
| 6,904,628 | B2 | | 6/2005 | Murphy et al. | |

OTHER PUBLICATIONS

Cover of *The Philadelphia Inquirer*, Home and Design Section (Apr. 21, 2000).

*UDM Design News*, p. 32 (Jun. 2000).

Home & Garden, *Sun-Sentinel*p. 3E (South Florida, Apr. 14, 2000).

Functional upholstery takes center state, *Furniture Today*, vol. 24, N. 30d, 2 pages (Apr. 9, 2000).

Photograph I. Version 1, sofa shown at trade show in San Francisco, folding center leg and Version 1 front leg actuator (Jan. 2000).

Photograph 2. Version 1, sofa shown at trade show in San Francisco, sofa partially opened (Jan. 2000).

Photograph 3. Version 1, sofa shown at trade show in San Francisco, sofa completely opened (Jan. 2000).

Photograph 4. Version 1, sofa shown at trade show in San Francisco, tube assembly front pivot offset and extended and folding center leg extended (Jan. 2000).

* cited by examiner

SEATING UNIT CONVERTIBLE TO BED

RELATED APPLICATION

This application is a continuation-in-part of U.S. patent application Ser. No. 12/505,697, filed Jul. 20, 2009, the disclosure of which is hereby incorporated herein in its entirety.

FIELD OF THE INVENTION

The present invention relates generally to furniture, and more specifically a furniture unit that is convertible into a bed.

BACKGROUND OF THE INVENTION

Furniture units that are convertible into beds are popular with consumers because of their multifunctionality. Many consumers find it very convenient to have a sofa or chair that can provide a bed for a guest, as such a unit can eliminate the need for an additional, separate bed. One popular sofa-bed design includes its own complete mattress that is folded within the cavity of the sofa during periods of non-use. One such example is illustrated in U.S. Pat. No. 4,200,941 to Gill et al. This type of sofa-bed can be quite heavy, and typically requires not only the separate mattress, but also a relatively intricate mechanism to control the unfolding and folding of the mattress.

Other furniture units lack a complete mattress, but instead are constructed of separate sections that serve as support surfaces of the sofa and unfold to form a flat, mattress-like sleeping surface. One example is shown in U.S. Pat. No. 2,740,131 to Vogel et al.; others are shown in U.S. Pat. No. 5,195,194 to Bradley and U.S. Patent Publication No. 2007/0283491 to Murphy, the disclosure of each of which is hereby incorporated herein in its entirety.

In spite of the existence of these different foldable beds, it may be desirable to offer additional furniture units that can house foldable beds.

SUMMARY OF THE INVENTION

As a first aspect, embodiments of the present invention are directed to a seating unit containing a foldable bed. The seating unit comprises: a seating unit frame having a pair of opposed arms; a housing including a storage cavity, the housing fixed to the arms of the seating unit frame; a seat section; an intermediate section; a head section; and a mechanism having pivotally interconnected links, the mechanism interconnecting the base with the head, intermediate and seat sections. The mechanism controls the movement of the head, intermediate and seat sections between a folded position, in which the head, intermediate and seat sections are positioned in vertically stacked relationship, with the head section below the intermediate section and the seat section above the intermediate section, the head and intermediate sections being positioned in the cavity of the housing, and the head and intermediate sections being generally horizontally disposed and the seat section having a pitch angle of between about 1 and 7 degrees to horizontal, and an unfolded position, in which the head, intermediate and seat sections are horizontally disposed and serially aligned to form a sleeping surface.

As a second aspect, embodiments of the present invention are directed to a seating unit containing a foldable bed comprising: a seating unit frame having a pair of opposed arms; a housing including a storage cavity, the housing fixed to the arms of the seating unit frame, the housing including front and rear walls; a seat section; an intermediate section; a head section; and a mechanism having pivotally interconnected links, the mechanism interconnecting the base with the head, intermediate and seat sections. The mechanism controls the movement of the head, intermediate and seat sections between a folded position, in which the head, intermediate and seat sections are positioned in vertically stacked relationship, with the head section below the intermediate section and the seat section above the intermediate section, the head and intermediate sections being positioned in the cavity of the housing, and the head and intermediate sections being generally horizontally disposed and the seat section having a pitch angle and resting on the front and rear walls of the housing, and an unfolded position, in which the head, intermediate and seat sections are horizontally disposed and serially aligned to form a sleeping surface.

As a third aspect, embodiments of the present invention are directed to a seating unit containing a foldable bed comprising: a seating unit frame having a pair of opposed arms; a housing including a storage cavity, the housing fixed to the arms of the seating unit frame; a seat section; an intermediate section; a head section; a mechanism having pivotally interconnected links, the mechanism interconnecting the base with the head, intermediate and seat sections; a backrest; and a backrest raising mechanism. The mechanism controls the movement of the head, intermediate and seat sections between a folded position, in which the head, intermediate and seat sections are positioned in vertically stacked relationship, with the head section below the intermediate section and the seat section above the intermediate section, the head and intermediate sections being positioned in the cavity of the housing, and the head and intermediate sections being generally horizontally disposed and the seat section having a pitch angle and resting on the front and rear walls of the housing, and an unfolded position, in which the head, intermediate and seat sections are horizontally disposed and serially aligned to form a sleeping surface. The backrest raising mechanism is attached to the backrest and to the frame and is configured to move the backrest between a lowered position, in which the backrest is generally upright and disposed above a rear portion of the seat, and a raised position, in which a lower portion of the backrest is positioned forwardly and upwardly from its location in the lowered position.

DETAILED DESCRIPTION OF EMBODIMENTS OF THE INVENTION

Figure 1:
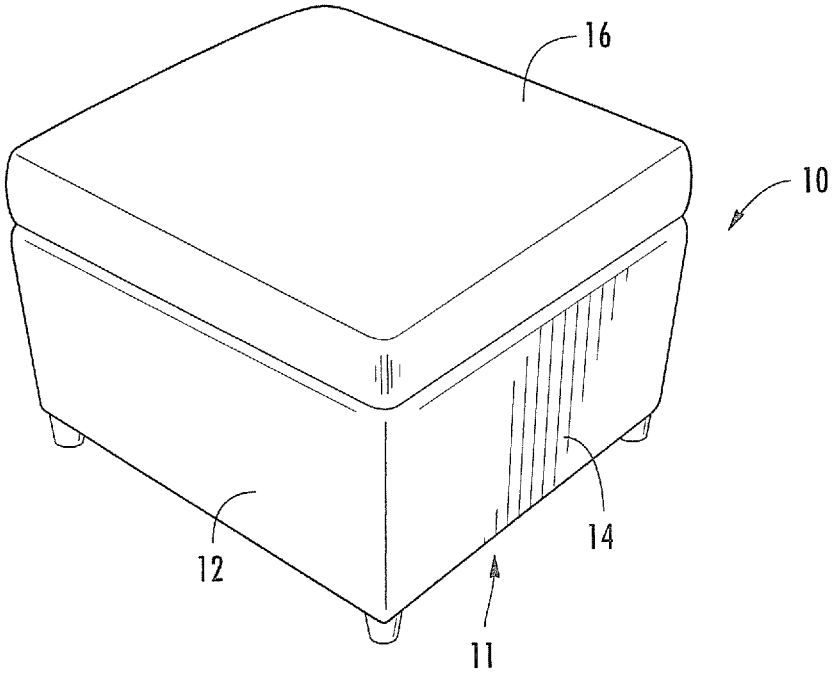
FIG. 1 is a perspective view of an ottoman containing a foldable bed according to embodiments of the present invention.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity. Well-known functions or constructions may not be described in detail for brevity and/or clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Referring now to the figures, an ottoman, designated broadly at 10, is illustrated in FIGS. 1-6. The ottoman 10 includes a base 11 having a front wall 12, a rear wall 13, and opposed side walls 14 that define a cavity 17. A foldable bed 15 includes a seat section 16 with an underlying seat panel 18, an intermediate section 20 with an underlying seat panel 22, and a head section 24 with an underlying head panel 26. The bed 15 is movable between a folded position, in which the seat, intermediate and head sections 16, 20, 24 are generally horizontally disposed and positioned in vertically stacked relationship, with the head section 24 below the intermediate section 20 and the seat section 16 above the intermediate section 20, and with the head and intermediate sections 24, 20 being positioned in the cavity 17 of the base 11 (see FIG. 2), and an unfolded position, in which the seat, intermediate and head sections 16, 20, 24 are horizontally disposed and serially aligned to form a sleeping surface (see FIGS. 5 and 6).

The movement of the sections 16, 20, 24 of the bed 15 is controlled by a pair of mechanisms 30, which will be described in greater detail below. The mechanisms 30 are mirror images of each other about a vertical plane P (FIG. 6) that bisects the ottoman 10 normal to the front wall 12; as such, only one mechanism 30 will be described herein, with the understanding that the description is applicable to the other mechanism also.

For the sake of clarity, the bed 15 will be described initially in the unfolded position of FIGS. 5 and 6; movement to the folded position of FIG. 2 will then follow. As used herein to describe the relative positions of components, the terms "lateral", "outward" and derivatives thereof indicate the directions defined by a vector beginning at the vertical plane P that bisects the ottoman 10 normal to the front wall 12. Conversely, the terms "inward", "inboard" and derivatives thereof indicate the direction opposite the "outward" direction. Together, the "inward" and "outward" directions comprise the "transverse" axis of the ottoman 10. The "rear" of the unfolded bed 15 is located at the end of the bed 15 nearest the rear wall 13 of the base 11 (i.e., toward the head section 24), and the "front" of the bed 15 is located at the end nearest the seat section 16. The "front" and "rear" directions comprise the "longitudinal" axis of the bed 15.

In addition, some components of the mechanisms 30 are illustrated herein as a series of pivotally interconnected links. Those skilled in this art will appreciate that the pivots between links or other components can take a variety of configurations, such as pivot pins, rivets, bolt and nut combinations, and the like, any of which may be suitable for use with the present invention. Also, the shapes and configurations of the links themselves may vary, as will be understood by those skilled in this art. Further, some links may be omitted entirely in some embodiments, and additional links may be included in some embodiments.

Figure 5:
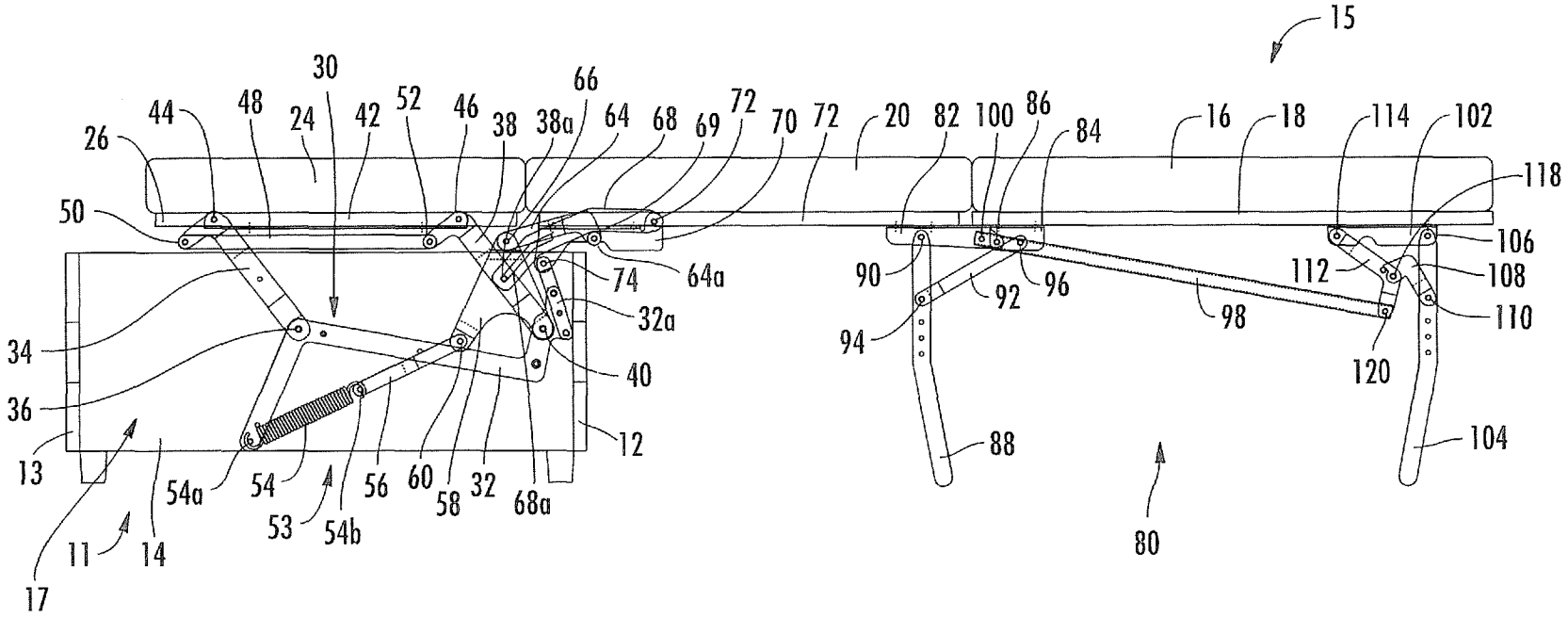
FIG. 5 is a cutaway side view of the ottoman of FIG. 1 with the foldable bed shown in its unfolded position.
Figure 6:
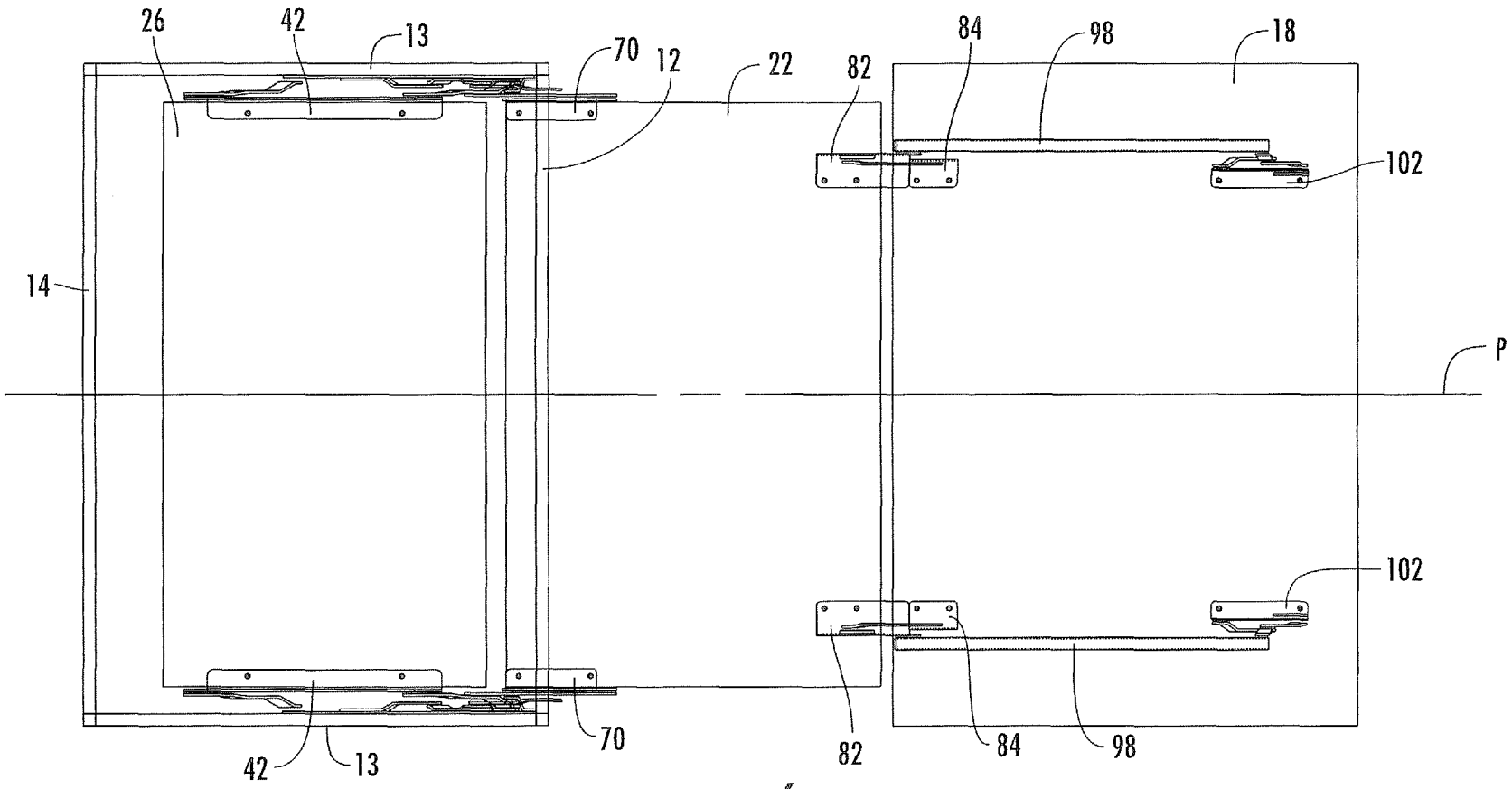
FIG. 6 is a top view of the ottoman of FIG. 1 with the foldable bed shown in its unfolded position.

Referring now to FIGS. 5 and 6, the mechanism 30 includes a Z-shaped mounting bracket 32 that is fixed to the inner surface of the side wall 14. An extension 32*a* extends upwardly from the forward leg of the mounting bracket 32. An angled rear swing link 34 is attached to the mounting bracket 32 at a pivot 36 located the rear vertex thereof and extends upwardly and rearwardly therefrom. A similarly-shaped front pivot link 38 is attached to the mounting bracket 32 at a pivot 40 located near the extension 32*a*; the front pivot link 36 extends upwardly and rearwardly from the pivot 38. A head section mounting bracket 42 is mounted to the lateral edge of the head panel 26. The rear swing link 34 is attached to the head section mounting bracket 42 at a pivot 44, and the front swing link 38 is attached to the head section mounting bracket 42 at a pivot 46. A connecting link 48 extends parallel to and below the head section mounting bracket 42 and is attached to the ends of the rear and front swing links 34, 38 at pivots 50, 52 respectively. These links control the movement of the head section 24 between the folded and unfolded positions.

A coupling link 68 is attached to the front swing link 38 via a pin 38*a* on the front swing link 38 that is received in a slot 68*a* in the coupling link 68. In the unfolded position of FIGS. 5 and 6, the pin 38*a* is positioned in the rear end of the slot 68*a*. The coupling link 68 extends upwardly and forwardly from the pin 38*a* to terminate at a pivot 72 with a rear intermediate section mounting bracket 70 fixed to the side of the intermediate panel 22. The rear intermediate section mounting bracket 70 is also attached to the extension 32*a* of the mounting bracket 32 at a pivot 74. These links control the movement of the intermediate section 20 between the folded and unfolded positions and couple the movement of the intermediate section 20 to the head section 24. In addition, the coupling link 68 maintains the head section 24 in position via the interaction between the pin 38*a* of the front swing link 38 and the rear end of the slot 68*a* of the coupling link 68.

Still referring to FIGS. 5 and 6, the mechanism 30 also includes a leg folding unit 80, which has a front intermediate section mounting bracket 82 that is fixed to the forward end of the intermediate panel 22. At its forward end, the front intermediate section mounting bracket 82 is attached to a rear seat section mounting bracket 84 at a pivot 86. An intermediate leg 88 is attached to the front intermediate section mounting bracket 82 at a pivot 90. A brace 92 is attached to the intermediate leg 88 at a pivot 94 and to the rear seat section mounting bracket 84 at a pivot 96. These components control the movement of the intermediate leg 88 between the folded and unfolded positions.

Referring again to FIGS. 5 and 6, a connecting rod 98 is attached to the front intermediate section mounting bracket 82 at a pivot 100, which is located just rearwardly of the pivot 86. The connecting rod 100 extends forwardly and slightly downwardly from the pivot 86. A front seat section mounting bracket 102 is fixed to the seat panel 18. An angled folding link 112 is attached to the rear end of the front seat section mounting bracket 102 at a pivot 114 and extends downwardly therefrom to terminate at a pivot 120 with the connecting link 98. A front leg 104 is attached to the front end of the front seat section mounting bracket 102 at a pivot 106 and extends downwardly therefrom. An angled control link 108 is attached to the front leg 104 at a pivot 110 and also to the vertex of the folding link 112 at a pivot 118. The folding link 112 and the control link 108 control the folding of the front leg 104, and the connecting rod 98 couples the front leg 104 to the folding motion of the intermediate section 20.

Referring once again to FIGS. 5 and 6, the mechanism 30 has a folding resist unit 53 that includes a spring 54. The spring 54 is mounted at its rear end to the rear portion of the mounting bracket 32 via a pin 54*a*, and is attached at its other end to a link 56 at a pin 54*b*. The link 56 is then attached to a generally triangular transition plate 58 at a pivot 60. The transition plate 58 is pivotally mounted to the mounting bracket 32 at the pivot 40. The upper end of the transition plate 58 is attached at a pivot 66 to a stop link 64. The stop link 64 extends forwardly from the pivot 66 to a pivot 69 with the rear intermediate section mounting bracket 70. A stop 64*a* contacts the underside of the coupling link 68. The spring 54 is in a relatively relaxed state.

Figure 2:
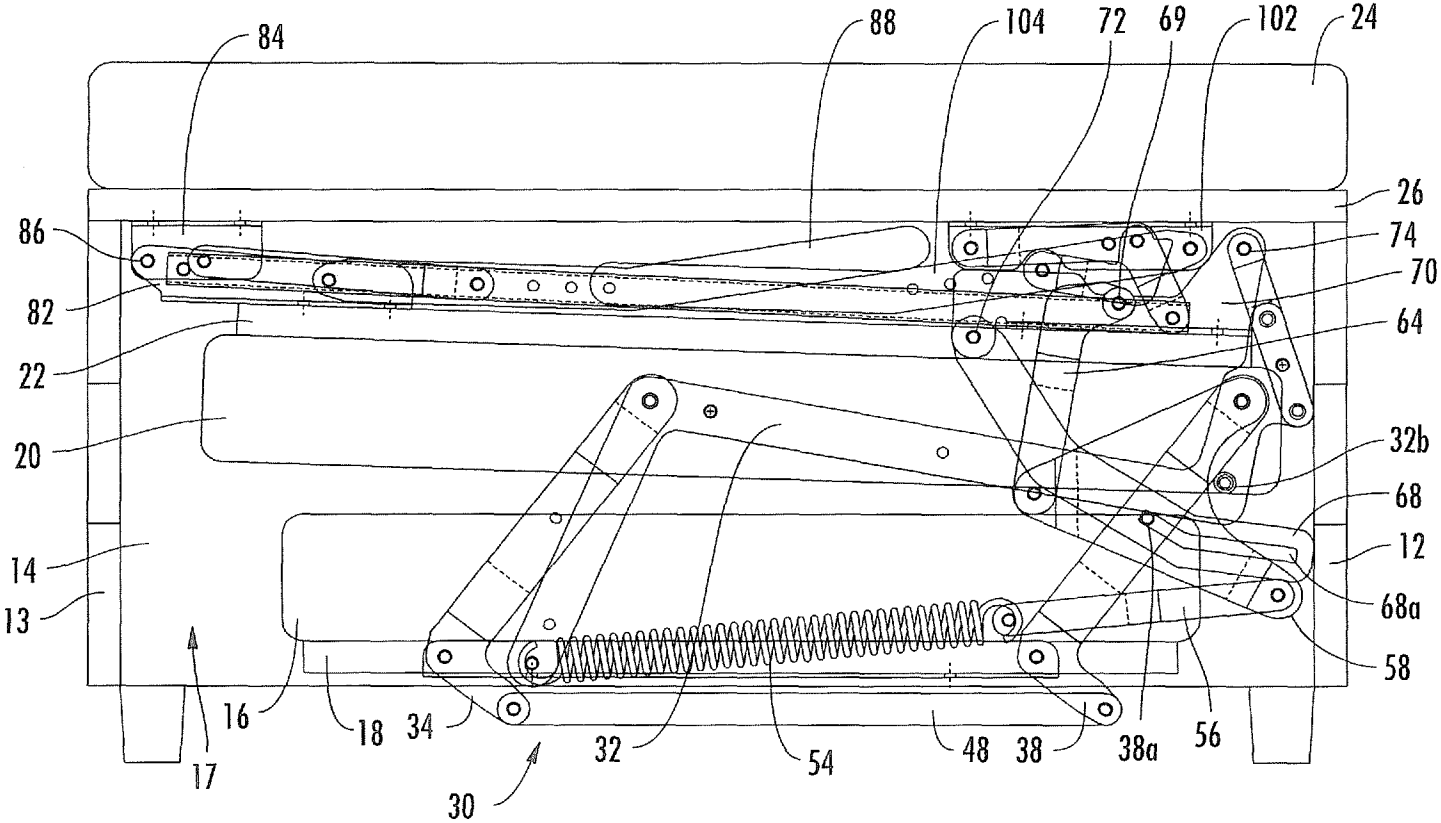
FIG. 2 is a cutaway side view of the ottoman of FIG. 1 with the foldable bed shown in its folded position.
Figure 3:
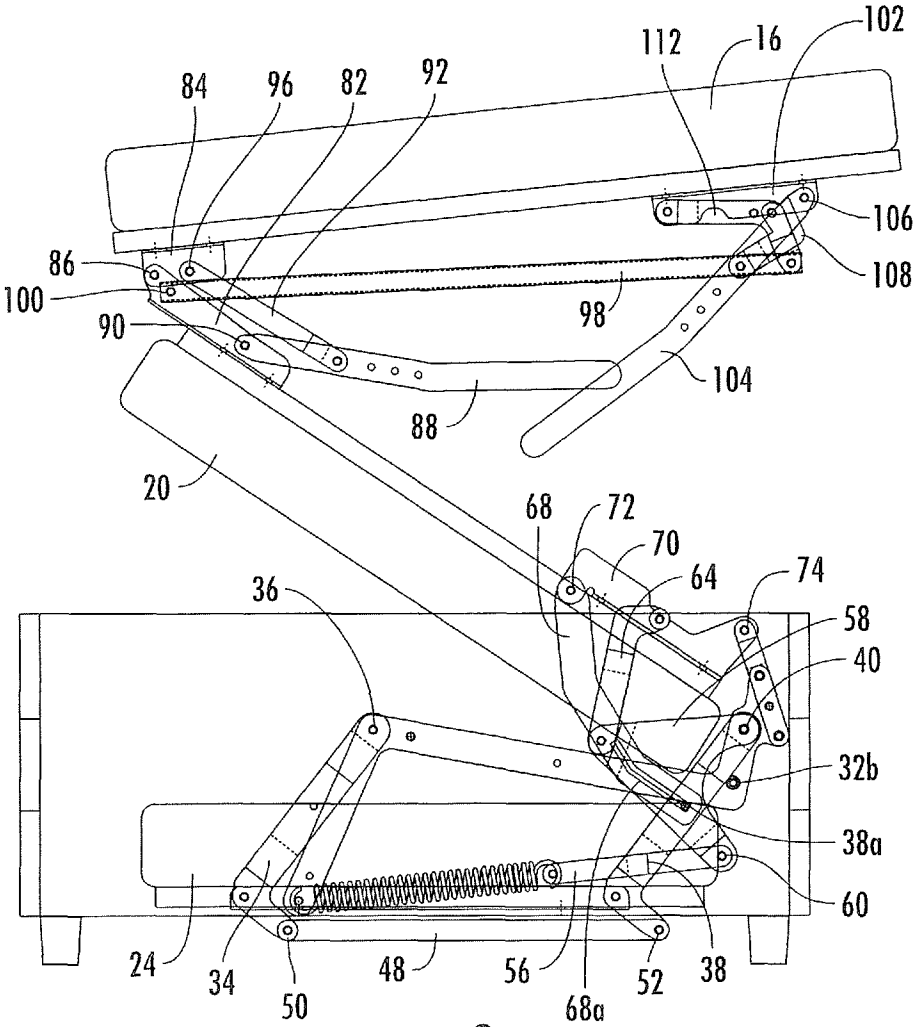
FIG. 3 is a cutaway side view of the ottoman of FIG. 1 with the foldable bed shown in an intermediate position.

To move the bed 15 from the unfolded position of FIGS. 5 and 6 to the folded position of FIG. 2, a user lifts the front end of the seat section 16. This action also lifts the intermediate section 20, which begins to pivot (counterclockwise from the vantage point of FIGS. 2-5 about the pivot 74. The rotation of the intermediate section 20 also forces the coupling link 68 and its slot 68*a* rearwardly and downwardly, which allows the head section 24, by virtue of its own weight, to descend as the rear and front swing links 34, 38 pivot counterclockwise about, respectively, the pivots 36, 40. This motion continues as until the front swing link 38 strikes the pin 32*b* on the mounting bracket 32, at which point the head section 24 has reached its lowest position within the cavity 13 (see FIG. 3). The intermediate section 20 continues to rotate counterclockwise about the pivot 74 (with the slot 68*a* of the coupling link 68 sliding relative to the pin 38*a*) until it reaches an inverted disposition above the head section 24 (FIG. 2).

Figure 4:
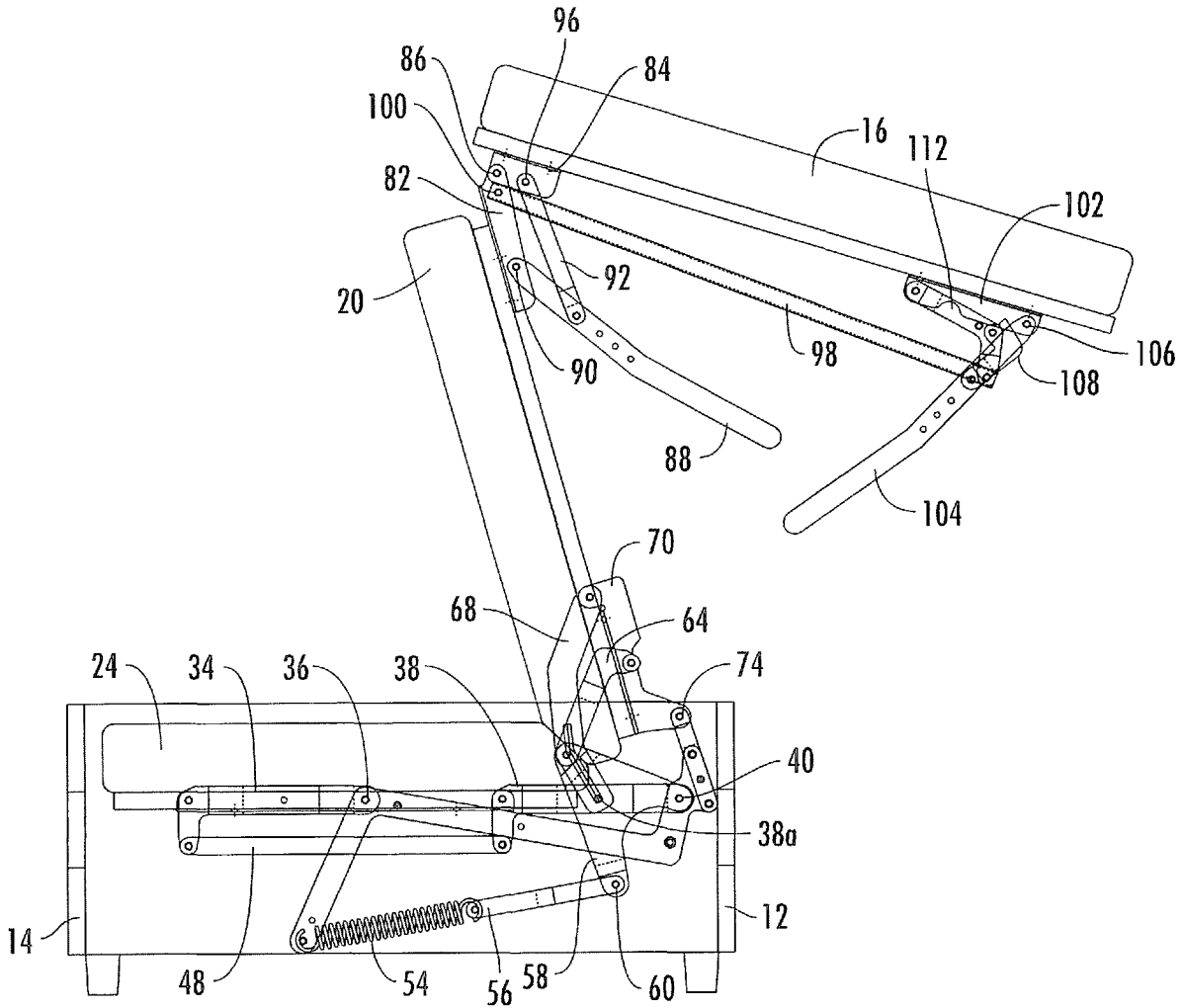
FIG. 4 is a cutaway side view of the ottoman of FIG. 1 with the foldable bed shown in another intermediate position.

It can be seen in FIG. 4 that, as the head section 24 descends, it reaches a position in which the pivots 36, 40 are aligned with the pivots 44, 46. In this position, in the absence of the connecting link 42, the head section 24 could tend to become unstable and begin to twist or shift rather than continuing to descend in a horizontal disposition. The connecting link 48 can prevent such unwanted twisting.

It can also be seen that as the intermediate section 20 rotates about the pivot 74, the stop link 64 moves rearwardly and forces the transition plate 58 to rotate counterclockwise about the pivot 40. Rotation of the transition plate 58 causes the spring 54 to stretch (FIGS. 3 and 4) and thereby resist the rotation of the transition plate 58. As a result, as the foldable bed 15 is moved toward the folded position of FIG. 2, the resistance provided by the spring 54 can help to prevent the bed 15 from dropping or slamming into place due to its weight.

Referring again to FIGS. 3-5, as the intermediate section 20 rotates about the pivot 74, the weight of the seat section 16 causes it to rotate clockwise relative to the intermediate section 20 about the pivot 86. This relative rotation of the seat section 16 forces the rear front seat section mounting bracket 84 toward the front intermediate section mounting bracket 82, which in turn forces the brace 92 toward the intermediate leg 88. The intermediate leg 88 rotates clockwise relative to the front intermediate section mounting bracket 82 about the pivot 90 and folds into a position that is generally parallel with the intermediate panel 22 and between the intermediate section 20 and the seat section 16 (see FIG. 2).

Simultaneously, the rotation of the seat section 16 relative to the intermediate section 20 forces the connecting rod 98 toward the front leg 104. This movement rotates the folding link 112 counterclockwise relative to the front seat section mounting bracket 102 about the pivot 114. This movement draws the control link 108 toward the front seat section mounting bracket 102, which in turn induces the front leg 104 to pivot clockwise relative to the front seat section mounting bracket 102 about the pivot 106.

The movement of the intermediate and front legs 88, 104 and the folding of the intermediate and seat sections 20, 16 are complete when the legs 88, 102 are folded between the intermediate and seat sections 20, 16, with the intermediate section 20 inverted from its disposition in the unfolded position (see FIG. 2). In this position, the seat section 16 is above the base 11 and can serve as a sitting or resting position for the ottoman.

It will be understood that the bed 15 can be unfolded from the base 11 by lifting the seat section 16 and drawing it forwardly. The links of unfolding mechanisms 30 reverse the movements described above, thereby enabling the bed 15 to move to the unfolded position of FIG. 5.

Although the foldable bed 15 is shown herein mounted in the housing of an ottoman, those skilled in this art will recognize that the bed 15 may be suitable for mounting in other furniture pieces. For example, the bed 15 may be mounted in a cocktail or occasional table. In particular, the table may have a movable top, such as that shown in U.S. Pat. No. 5,583,086 to Hoffman et al., the disclosure of which is hereby incorporated herein in its entirety. In such a unit, the top could be moved to its raised position, at which point the bed 15 could be unfolded from the base. The bed 15 could also be mounted and stored in a cabinet or chest.

Figure 7:
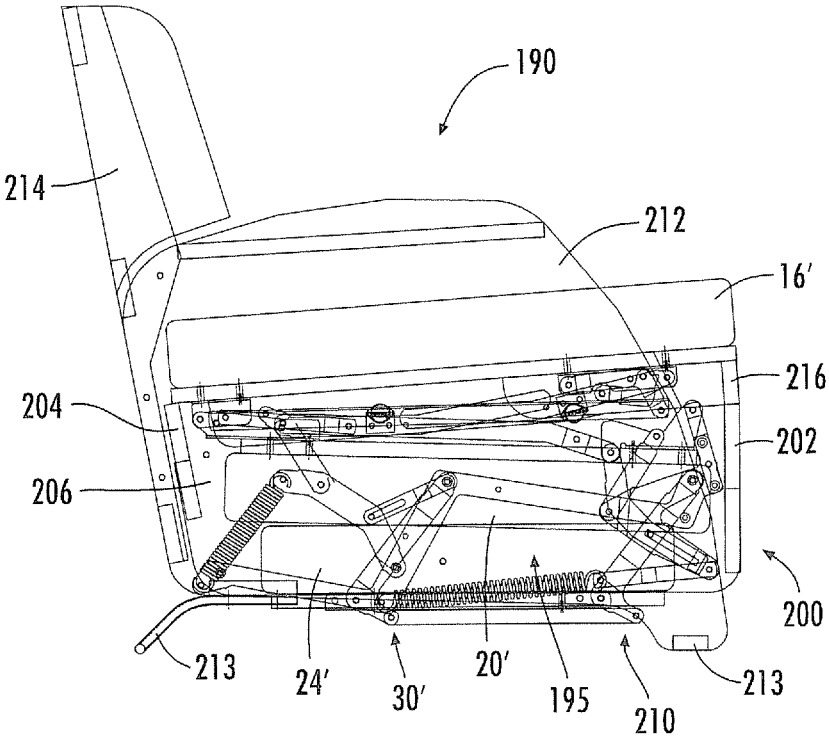
FIG. 7 is a cutaway side view of a seating unit containing a foldable bed according to embodiments of the present invention, with the bed shown in its folded position.
Figure 8:
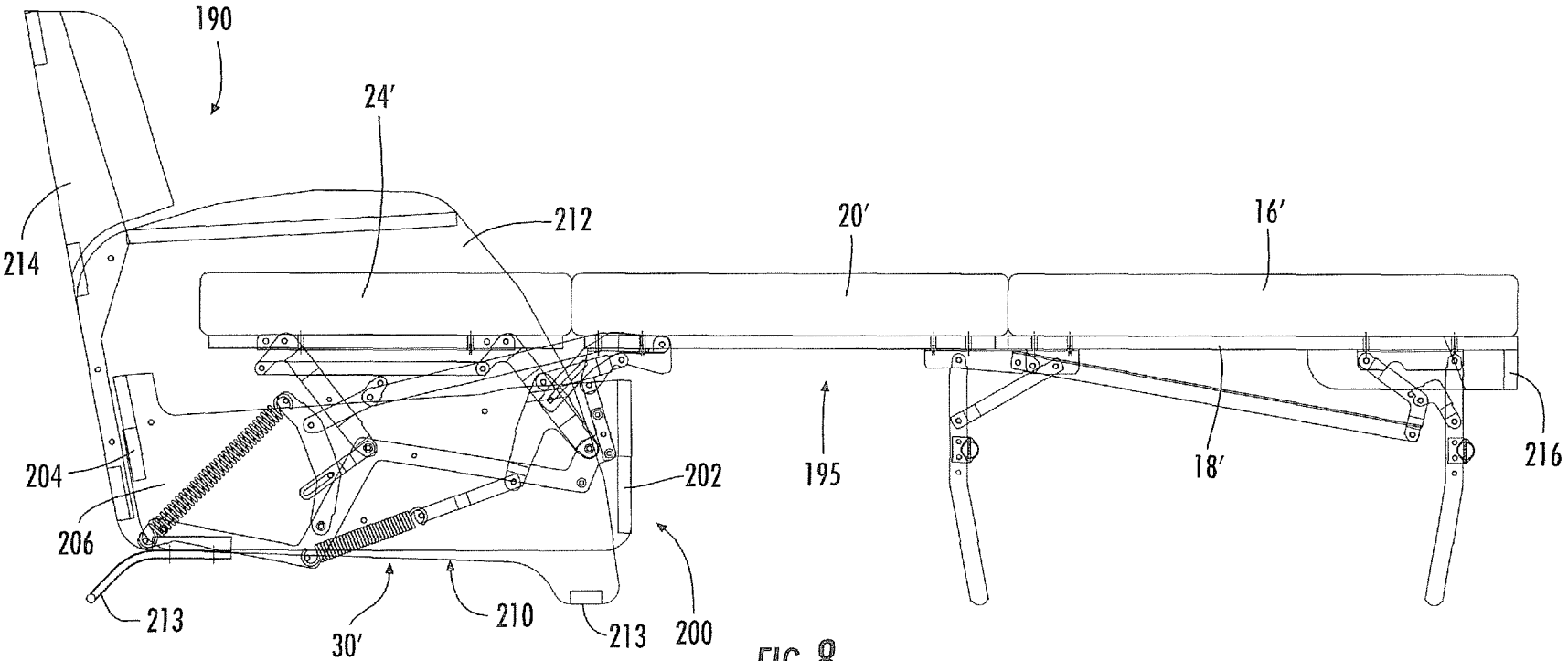
FIG. 8 is a cutaway side view of the seating unit of FIG. 7 with the bed shown in its unfolded position.
Figure 9:
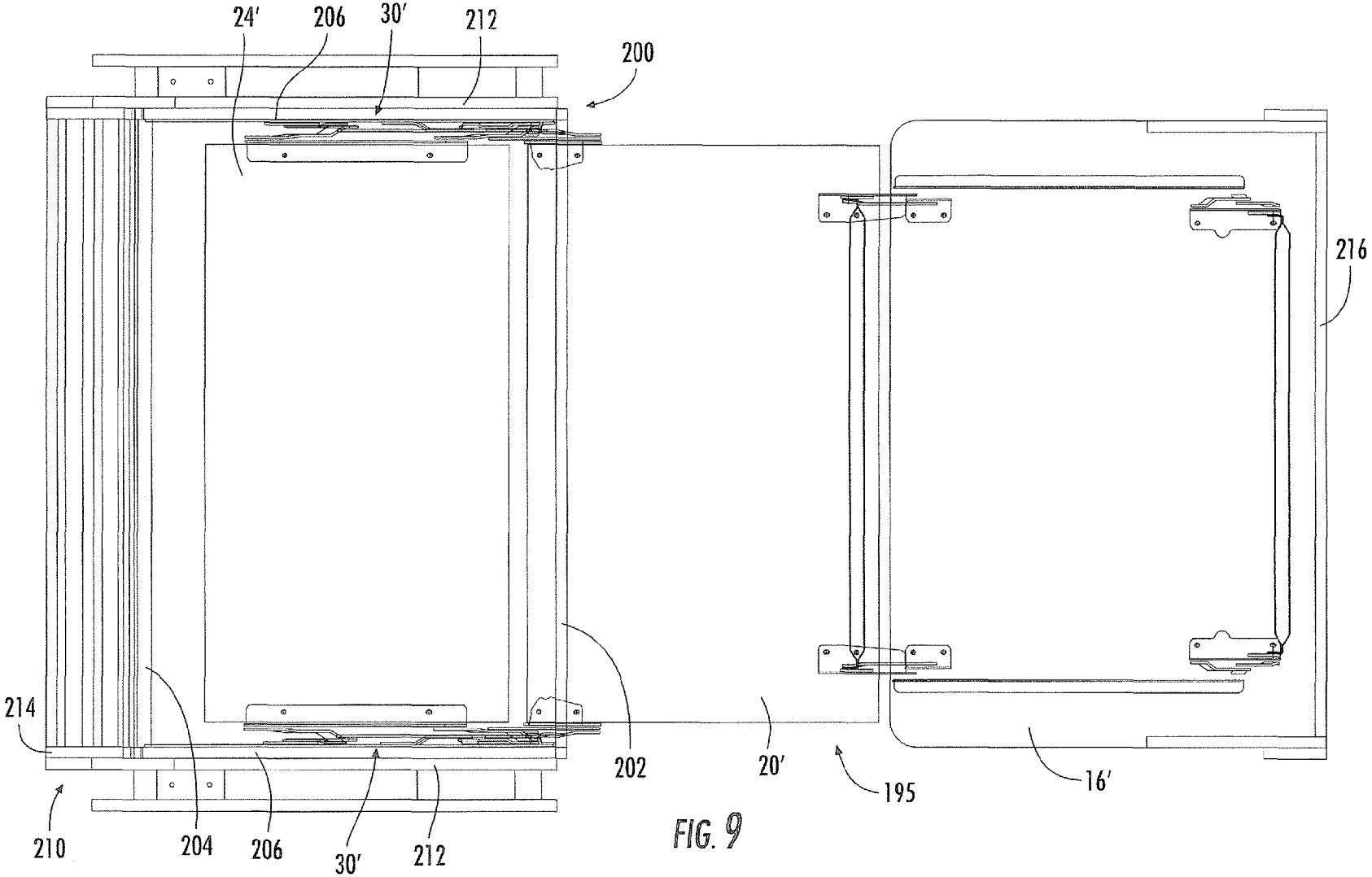
FIG. 9 is a top view of the seating unit of FIG. 7 with the bed shown in its unfolded position.

In addition, the foldable bed 15 could be mounted to a chair, sofa, sectional sofa, or the like. Referring now to FIGS. 7-9, a seating unit 190 containing a foldable bed 195 is illustrated therein. The seating unit 190 includes a frame 210 having opposing arms 212 supported by feet 213 and a backrest 214 that spans the arms 212. A four-walled housing 200 is fixed to the frame 210. The housing 200 includes a front wall 202, a rear wall 204, and side walls 206 that span the front and rear walls 202, 204. The side walls 206 are fixed to the inner surfaces of the arms 212 (see FIG. 9).

An unfolding mechanism 30' that is substantially identical to the unfolding mechanism 30 described above in connection with the ottoman 10 is mounted to the side walls 206 via mounting brackets 32'. The intermediate and head sections 20', 24' are substantially identical to those discussed above. The seat section 16' has a seat panel 18' to which is attached a shimming panel 216. The shimming panel 216 extends downwardly from the front edge of the seat panel 18'.

As can be seen in FIG. 7, in the unfolded position the shimming panel 216 rests on the upper edge of the front wall 202 of the housing 200, and the rear portion of the seat panel 18' rests on the upper edge of the rear wall 204. The presence of the shimming panel 216 causes the seat section 16' to have a pitch angle when the seating unit 190 is in the folded position. The pitch angle is typically between about 1 and 7 degrees. Those of skill in this art will appreciate that other structures within the housing 200 and/or the frame 210 may also be employed to provide a desired pitch angle to the seat section 16'.

Unfolding and folding of the bed 195 occurs in the same manner as described above for the foldable bed 15.

Also, the presence of the housing 200 can simplify construction of the seating unit 190. For example, the mechanisms 30' and the seat, head and intermediate sections 16', 20', 24° can be mounted within the housing 200, and this assembly can then be shipped to a seating unit manufacturer. The manufacturer can then simply fix a seating unit frame (i.e., arms and likely a backrest) of its own choosing and design to the housing 200 to produce a desired style.

Figure 11:
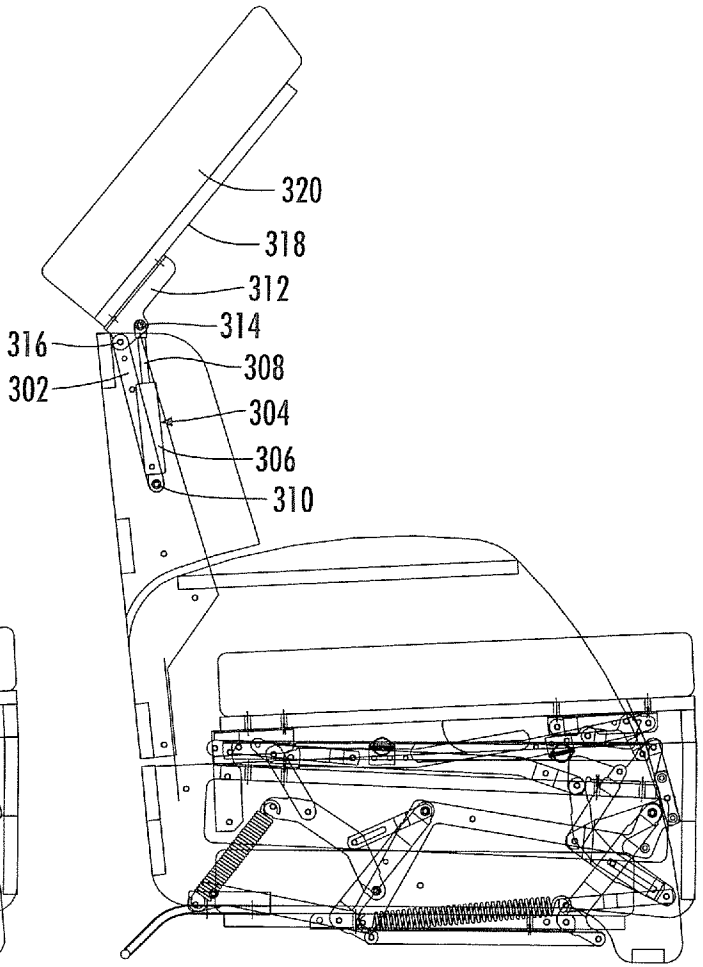
FIG. 11 is a cutaway side view of the seating unit of FIG. 10 with the backrest shown in a raised position.
Figure 10:
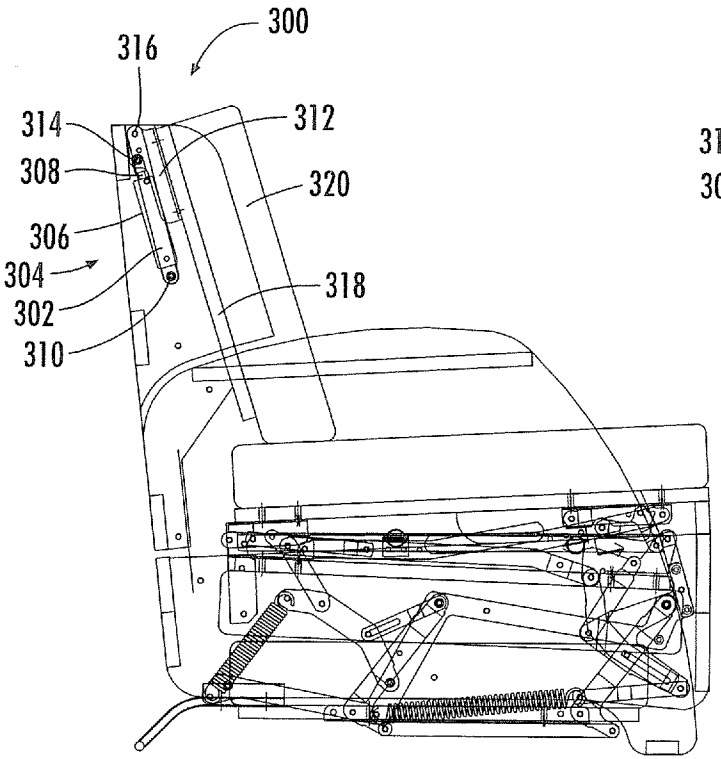
FIG. 10 is a cutaway side view of a seating unit according to additional embodiments of the present invention, with the backrest shown in a lowered position.

Referring now to FIGS. 10 and 11, another embodiment of a seating unit, designated broadly at 250, is illustrated therein. The seating unit 250 is identical to the seating unit 200 with the exception of including a movable rear cushion assembly 300. As shown in FIG. 10, the assembly 300 includes a lifting mechanism 301 having a straight mounting bracket 302 that is mounted to the back wing 301 of the seating unit 250. A pneumatic cylinder unit 304 having a cylinder 306 and a retractable rod 308 is mounted to the lower end of the mounting bracket 302 at a pivot 310. A backrest mounting bracket 312 is attached to the upper end of the mounting bracket 302 at a pivot 316. The upper end of the rod 308 is mounted to the mounting bracket 312 at a pivot 314. The backrest mounting bracket 312 is then mounted to a backrest panel 318 that underlies a backrest cushion 320.

As can be seen in FIG. 10, in a lowered position (in which the seating unit 250 serves as a chair or sofa), the backrest assembly 300 provides a backrest to the seating unit 250, with the backrest cushion 320 in a conventional, generally upright disposition. The rod 308 of the pneumatic cylinder unit 304 is retracted, such that the cylinder unit 304 is in compression. The axis of the rod 308 (along which the pivots 310, 314 lie, and along which the compressive force is directed) is slightly rearward of the line formed by the pivots 310, 316 on the mounting bracket 302. As such, the compressive force provided by the cylinder unit 304 biases the backrest mounting bracket 312, and in turn the backrest panel 318 and backrest cushion 320, clockwise, which maintains the backrest assembly 300 in the seating position.

Referring now to FIG. 11, the backrest assembly 300 can be moved to a raised position. A forwardly-directed force applied at the bottom edge of the backrest cushion 320 causes the backrest cushion 320, panel 318 and mounting bracket 312 to rotate counterclockwise about the pivot 316. This rotation draws the upper end of the rod 308 forwardly. Once the pivot 314 at the upper end of the rod passes the line formed by the pivots 310, 316, the cylinder unit 304 begins to force the rod 308 to extend, which biases the backrest cushion 320 and panel 318 toward a lifted position in which the lower end of the backrest cushion 320 (i.e., the end farthest from the pivot 316) is raised above the pivot 316. The biasing provided by the pneumatic cylinder unit 304 maintains the backrest cushion 320 in the raised position. In the raised position, the backrest cushion 320 and panel 318 are out of the way of the foldable bed 15, which can then unfold without interference from the backrest cushion 320 and backrest panel 318.

The inclusion of the backrest assembly 300 can allow different types and styles of backrest cushions, such as those that are attached securely at their lower ends to a backrest panel or the like, to be used with the foldable bed 15. Also, because the backrest is raised out of the way, a seat that is deeper in its front to back dimension can be used than in other configurations, which can in turn provide a longer sleeping surface (e.g., at least 74 inches).

Those skilled in this art will appreciate that other configurations of the lifting mechanism 301 may also be employed. For example, the pneumatic cylinder unit 304 may be replaced by another type of biasing unit, such as a compression spring or the like.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A seating unit containing a foldable bed, comprising:

a seating unit frame having a pair of opposed arms;

a housing including a storage cavity, the housing fixed to the arms of the seating unit frame;

a seat section;

an intermediate section;

a head section;

a mechanism having pivotally interconnected links, the mechanism interconnecting the base with the head, intermediate and seat sections;

wherein the mechanism controls the movement of the head, intermediate and seat sections between a folded position, in which the head, intermediate and seat sections are positioned in vertically stacked relationship, with the head section below the intermediate section and the seat section above the intermediate section, the head and intermediate sections being positioned in the cavity of the housing, and the head and intermediate sections being generally horizontally disposed and the seat section having a pitch angle and resting on the front and rear walls of the housing, and an unfolded position, in which the head, intermediate and seat sections are horizontally disposed and serially aligned to form a sleeping surface;

a backrest; and a backrest raising mechanism attached to the backrest and to the frame, the backrest raising mechanism configured to move the backrest between a lowered position, in which the backrest is generally upright and disposed above a rear portion of the seat, and a raised position, in which a lower portion of the backrest is positioned forwardly and upwardly from its location in the lowered position.

2. The seating unit defined in claim 1, wherein the backrest includes a backrest panel and a cushion affixed thereto, and wherein a lower edge of the backrest cushion is fixed to the backrest panel.

3. The seating unit defined in claim 1, wherein in the unfolded position, the length of the seat, intermediate and head sections is at least 74 inches.

4. The seating unit defined in claim 1, wherein the backrest raising mechanism includes a biasing unit that biases the backrest toward the lowered position when the backrest is in the lowered position.

5. The seating unit defined in claim 1, wherein the backrest raising mechanism includes a biasing unit that biases the backrest toward the raised position when the backrest is in the raised position.

* * * * *